US006207632B1

(12) United States Patent
Brooker et al.

(10) Patent No.: US 6,207,632 B1
(45) **Date of Patent: *Mar. 27, 2001**

(54) DETERGENT COMPOSITION COMPRISING A CATIONIC SURFACTANT AND A HYDROPHOBIC PEROXYACID BLEACHING SYSTEM

(75) Inventors: Alan Thomas Brooker, Newcastle upon Tyne; Michael Alan John Moss, Stocksfield; Richard Timothy Hartshorn, Wylam, all of (GB); Christiaan Arthur Jacques Kamiel Thoen, Haasdonk (BE); Ian Martin Dodd, Loughborough (GB)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/194,670

(22) PCT Filed: May 20, 1997

(86) PCT No.: PCT/US97/08560

§ 371 Date: Mar. 11, 1999

§ 102(e) Date: Mar. 11, 1999

(87) PCT Pub. No.: WO97/45513

PCT Pub. Date: Dec. 4, 1997

(30) Foreign Application Priority Data

May 31, 1996 (GB) ..... 9611320
Oct. 18, 1996 (GB) ..... 9621791

(51) Int. Cl.[7] ..... C11D 1/62; C11D 3/395

(52) U.S. Cl. ..... 510/310; 510/356; 510/445; 510/504

(58) Field of Search ..... 510/310, 313, 510/318, 356, 376, 445, 504

(56) References Cited

U.S. PATENT DOCUMENTS

| | | | | |
|---|---|---|---|---|
| 4,045,358 | | 8/1977 | Ramachandran | 252/8.6 |
| 4,222,905 | * | 9/1980 | Cockrell, Jr. | 510/295 |
| 4,239,659 | * | 12/1980 | Murphy | 510/331 |
| 4,333,862 | * | 6/1982 | Smith et al. | 510/341 |
| 4,634,551 | * | 1/1987 | Burns et al. | 510/313 |
| 4,686,063 | | 8/1987 | Burns | 510/375 |
| 4,688,063 | * | 8/1987 | Burns | 510/375 |
| 5,174,927 | * | 12/1992 | Honsa | 510/325 |
| 5,445,755 | * | 8/1995 | Convents et al. | 510/305 |
| 5,516,449 | * | 5/1996 | Agar et al. | 510/301 |

FOREIGN PATENT DOCUMENTS

| | | | | |
|---|---|---|---|---|
| 002084 | | 5/1979 | (EP) | C11D/1/00 |
| 170386 | * | 2/1986 | (EP) . | |
| 2292567 | | 2/1996 | (GB) | C11D/3/395 |
| WO95/03226 | | 7/1993 | (WO) | B65D/47/06 |
| WO97/03155 | | 1/1997 | (WO) . | |

* cited by examiner

*Primary Examiner*—Caroline D. Liott
(74) *Attorney, Agent, or Firm*—C. Brant Cook; Kim W. Zerby

(57) ABSTRACT

There is provided a detergent composition suitable for use in laundry or dish washing methods comprising: (a) a quaternary ammonium cationic surfactant; and (b) a hydrophobic organic peroxyacid bleaching system, capable of providing a hydrophobic organic peroxyacid compound.

6 Claims, No Drawings

DETERGENT COMPOSITION COMPRISING A CATIONIC SURFACTANT AND A HYDROPHOBIC PEROXYACID BLEACHING SYSTEM

TECHNICAL FIELD

The present invention relates to detergent compositions containing a cationic surfactant and a hydrophobic organic peroxyacid bleaching system, which are suitable for use in laundry and dishwashing methods.

BACKGROUND OF THE INVENTION

The satisfactory removal of greasy soils/stains, that is soils/stains having a high proportion of triglycerides or fatty acids, is a challenge faced by the formulator of detergent compositions for use in laundry and dish washing methods. Surfactant components have traditionally been employed in detergent products to facilitate the removal of such greasy soils/stains. In particular, surfactant systems comprising cationic esters have been described for use in greasy soil/stain removal.

A particular challenge to the formulator of detergent compositions for use in a laundry washing method is the satisfactory removal of bleachable soils/stains such as tea, fruit juice and coloured vegetable soils from stained fabrics. It is known that stained fabrics have a tendency to present a 'dingy' appearance after frequent washing. Bleaches are traditionally employed in detergents to remove the bleachable stains or soils, and also those responsible for the 'dingy' appearance of the fabric. It is well established that peroxygen bleaches and bleaching systems, based on organic peroxyacids can provide stain and/or soil removal from fabrics. The organic peroxyacids are often obtained by the in situ perhydrolysis of organic peroxyacid bleach precursor compounds (bleach activators). To remove greasy stains/soils, which are of hydrophobic nature, hydrophobic organic peroxyacids can be employed in detergent products. Such organic peroxyacids generally comprise long chain (>7 carbon atoms) alkyl moieties. Hydrophobic bleaches are known to have a tendency to migrate rapidly to the surface of fabrics under wash conditions.

Bleaches which may be hydrophobic are disclosed for example in EP-A-0170386. It is stated that these bleaches may be used in compositions which incorporate different types of surfactant materials. Anionic, nonionic, zwitterionic and amphoteric surfactants are disclosed. Hydrophobic bleaching agents are also described in WO95/3226 as useful suds suppressants in detergent compositions containing high levels of surfactant.

Quaternary ammonium compounds are known cationic surfactants. For example in GB-A-2040990 alkoxylated nonionic and cationic surfactants and anionic surfactants are used in combination to produce detergents for fabric washing.

It has now been found that a problem with hydrophobic bleaches is that despite their tendency to migrate to the fabric surface, they do not necessarily interact fully with the stain or soil components. It has been found that the hydrophobic bleaches can be prevented from migration onto the greasy stains/soils by deposited 'lime soaps' (formed by alkaline earth ions with fatty acids, present in the wash solution) on the fabric. Thereby, their bleaching performance can be diminished. This result in a lessening of the dingy soil cleaning performance of the hydrophobic bleach.

The Applicants have found that this problem can be ameliorated by use of a particular combination of cationic surfactant and bleach resulting in a surprising enhancement of the bleach efficacy of the hydrophobic organic peroxyacid bleaching system. Thereby, the overall cleaning performance of the detergent are improved.

Three mechanisms are believed to be responsible for this unexpected benefit. First, the cationic surfactant is capable of reducing 'lime soap' deposition on the fabric surface, thereby facilitating the partition of the hydrophobic organic bleaches into the greasy stains/soils. Secondly, the cationic surfactant reduces the surface tension between the fabric and the wash solution. Thereby, the interaction with the greasy stains/soils on the fabric by the hydrophobic organic bleach agent will be facilitated. Thirdly, the cationic surfactant and the negatively charged hydrophobic organic peroxyacids, formed in the wash, can form a non-polar associated couple, which will partition rapidly into hydrophobic, greasy stains/soils on the fabric.

All documents cited in the present description are, in relevant part, incorporated herein by reference.

SUMMARY OF THE INVENTION

A detergent composition according to a first aspect of the present invention comprises (a) a cationic surfactant of the formula I:

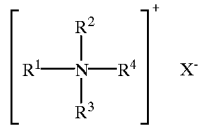

(I)

in which $R^1$ is a hydroxyalkyl group having no greater than 6 carbon atoms; each of $R^2$ and $R^3$ is independently selected from $C_{1-4}$ alkyl or alkenyl; $R^4$ is $C_{6-11}$ alkyl or alkenyl and $X^-$ is an anion; and (b) a hydrophobic organic peroxyacid bleaching system capable of providing a hydrophobic organic peroxyacid compound.

Preferred cationic surfactants of formula I are those in which $R^1$ is —$CH_2CH_2OH$ or —$CH_2CH_2CH_2OH$; each of $R^2$ and $R^3$ are, independently, $C_{1-4}$ alkyl; $R^4$ is $C_{6-11}$ alkyl or alkenyl and $X^-$ is an anion.

An essential feature of detergent compositions of the invention is a hydrophobic organic peroxyacid bleaching system capable of providing a hydrophobic organic peroxyacid compound. By hydrophobic organic peroxyacid compound it is meant herein an organic peroxyacid whose parent carboxylic acid has a critical micelle concentration less than 0.5 moles/litre and wherein said critical micelle concentration is measured in aqueous solution at 20°–50° C.

Preferably, the hydrophobic organic peroxyacid contains at least 7 carbon atoms, more preferably at least 9 carbon atoms, most preferably at least 11 carbon atoms. In a preferred aspect the peroxyacid has an alkl chain comprising at least 7 carbon atoms, more preferably at least 8 carbon atoms, most preferably at least 9 carbon atoms.

A preferred hydrophobic organic peroxyacid bleaching system is capable of providing a peroxyacid compound of the formula:

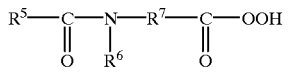

or

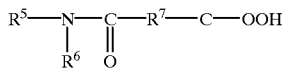

wherein $R^5$ is an alkyl, aryl or aralkyl group containing from 1 to 14 carbon atoms, $R^7$ is an alkylene, arylene or alkarylene group containing from 1 to 14 carbon atoms, and $R^6$ is H or an alkyl, aryl or alkaryl group containing from 1 to 10 carbon atoms.

According to a second aspect of the invention there is provided a detergent composition comprising A detergent composition comprising (a) less than 5% by weight of a cationic surfactant of the formula

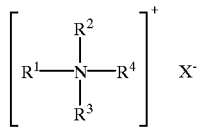

in which $R^1$ is a hydroxyalkyl group having no greater than 6 carbon atoms; each of $R^2$ and $R^3$ is independently selected from $C_{1-4}$ alkyl or alkenyl; $R^4$ is a $C_{12-14}$ alkyl or alkenyl and $X^-$ is an anion; and (b) a hydrophobic organic peroxyacid bleaching system, capable of providing a peroxyacid compound of the formula:

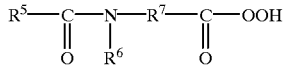

or

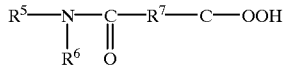

wherein $R^5$ is an alkyl, aryl or aralkyl group containing from 1 to 14 carbon atoms, $R^7$ is an alkylene, arylene or alkarylene group containing from 1 to 14 carbon atoms, and $R^6$ is H or an alkyl, aryl or alkaryl group containing from 1 to 10 carbon atoms.

Particularly preferred cationic surfactants of formula I in which $R^1$ is $HOCH_2CH_2$— or $HOCH_2CH_2CH_2$—; each of $R^2$ and $R^3$ are, independently, $C_{1-4}$ alkyl; $R^4$ is $C_{12-14}$ alkyl or alkenyl and $X^-$ is an anion.

Preferred detergent compositions of the invention additionally comprise a hard base polymeric component.

Unless otherwise stated alkyl or alkenyl as used herein may be branched, linear or substituted. Substituents may be for example, aromatic groups, heterocyclic groups containing one or more N, S or O atoms, or halo substituents.

DETAILED DESCRIPTION OF THE INVENTION

Cationic Surfactant

An essential element of the detergent compositions of the invention is a cationic quaternary ammonium surfactant. The cationic surfactant unless otherwise stated may be present in amounts up to 10.0% by weight of the detergent composition. However, preferably the maximum amount of the cationic surfactant in the detergent composition is below 5%. Most preferably, the cationic surfactant will be present in an amount below 4% or even 4.5% by weight of the detergent composition. Generally there will be at least 0.05% by weight or even at least 0.1% or at least 0.5% by weight of the cationic surfactant in the composition.

Preferably the —OH group in $R^1$ in formula I is separated from the quaternary ammonium nitrogen atom by no more than 3 carbon atoms. Preferred $R^1$ groups are —$CH_2$—$CH_2OH$, —$CH_2CH_2CH_2OH$, $CH_2CH_2(CH_3)OH$ and —$CH(CH_3)CH_2OH$. $CH_2CH_2OH$ and —$CH_2CH_2CH_2OH$ are most preferred and —$CH_2CH_2OH$ is particularly preferred. Preferably $R^2$ and $R^3$ are each selected from ethyl and methyl groups and most preferably both $R^2$ and $R^3$ are methyl groups. Preferred $R^4$ groups have at least 6 or even at least 7 carbon atoms. $R^4$ may have no greater than 9 carbon atoms, or even no greater than 8 or 7 carbon atoms. Preferred $R^4$ groups are linear alkyl groups. Linear $R^4$ groups having from 8 to 11 carbon atoms, or from 8 to 10 carbon atoms are preferred.

In accordance with a preferred aspect of the present invention the cationic surfactant of formula I has a $R^1$ group which is —$CH_2CH_2OH$. Preferably each of $R^2$ and $R^3$ are methyl groups.

In a preferred aspect of the invention, $R^4$ is a linear alkyl group, preferably a $C_{6-11}$ linear alkyl group.

It has been found that mixtures of the cationic surfactants of formula I may be particularly effective, for example surfactant mixtures in which $R^4$ may be a combination of $C_8$ and $C_{10}$ linear alkyl groups, or $C_9$ and $C_{11}$ linear alkyl groups. According to one aspect of the invention a mixture of cationic surfactants of formula I is present in the composition, the mixture comprising a shorter alkyl chain surfactant of formula I and a longer alkyl chain surfactant of formula I. The longer alkyl chain cationic surfactant is preferably selected from the surfactants of formula I where $R^4$ is an alkyl group having n carbon atoms where n is from 8 to 11; the shorter alkyl chain surfactant is preferably selected form those of formula I where $R^4$ is an alkyl group having (n-2) carbon atoms. Preferably the detergent compositions of the invention comprise a combination of cationic surfactants for formula I comprising 1% to 65% of a shorter alkyl chain length $R^4$ group and 35% to 99% by weight of a longer alkyl chain length. Mixtures comprising $R^4$ groups of $C_8$ and $C_{10}$ alkyl groups are particularly preferred.

X in formula I may be any counteranion providing electrical neutrality, but is preferably selected from the group consisting of halide, methyl sulfate, sulfate and nitrate, more preferably being selected from methyl sulfate, chloride, bromide or iodide.

Hydrophobic Organic Peroxyacid Bleaching System

Preferably the hydrophobic organic peroxyacid bleaching system comprises a hydrogen peroxide source and a hydrophobic organic peroxyacid bleach precursor compound. The production of the hydrophobic organic peroxyacid occurs by an in situ reaction of the precursor with a source of hydrogen peroxide. Preferred sources of hydrogen peroxide include inorganic perhydrate bleaches. In an alternative preferred execution the hydrophobic organic peroxyacid bleaching system comprises a preformed hydrophobic organic peroxyacid, which is incorporated directly into the composition. Compositions containing mixtures of a hydrogen peroxide source and hydrophobic organic peroxyacid precursor in combination with a preformed hydrophobic organic peroxyacid are also envisaged.

Inorganic Perhydrate Bleaches

Inorganic perhydrate salts are a preferred source of hydrogen peroxide. These salts are normally incorporated in the form of the alkali metal, preferably sodium salt at a level of from 1% to 40% by weight, more preferably from 2% to 30% by weight and most preferably from 5% to 25% by weight of the compositions.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps.

Sodium perborate is a preferred perhydrate salt and can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Potassium peroxymonopersulfate is another inorganic perhydrate salt of use in the detergent compositions herein.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

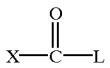

where L is a leaving group and X is essentially any functionality, such that on perhydrolysis the structure of the peroxyacid produced is

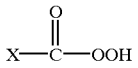

For the purposes of the present invention X will thus contain at least 6 carbon atoms.

The hydrophobic peroxyacid bleach precursor compounds are preferably incorporated at a level of from 0.05% to 20% by weight, more preferably from 0.1% to 15% by weight, most preferably from 0.2% to 10% by weight of the detergent compositions.

Suitable hydrophobic peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

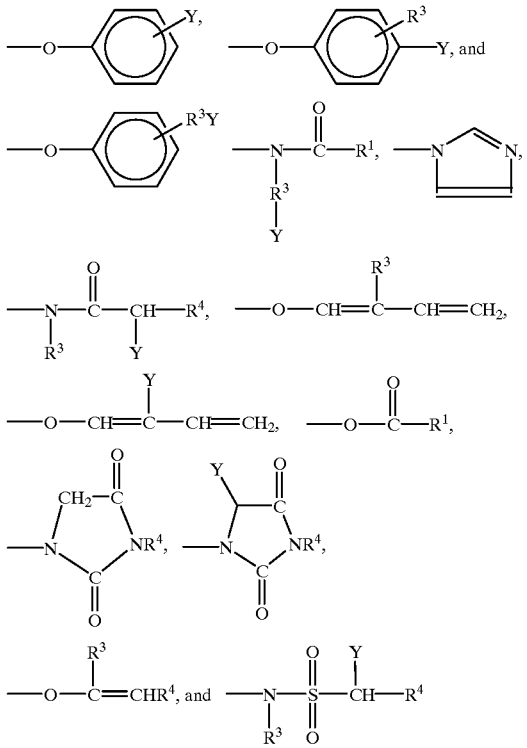

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Amide Substituted Alkyl Peroxyacid Precursors

The amide substituted alkyl peroxyacid precursors of the second aspect of the invention are also preferred in the first aspect of the invention. These include compounds of the following general formulae:

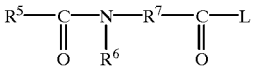

or

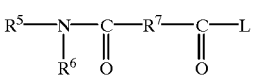

wherein $R^5$ is an aryl or alkaryl group with from about 1 to about 14 carbon atoms, $R^7$ is an alkylene, arylene, and alkarylene group containing from about 1 to 14 carbon atoms, and $R^6$ is H or an alkyl, aryl, or alkaryl group containing 1 to 10 carbon atoms and L can be essentially any leaving group. $R^5$ preferably contains from about 6 to 12 carbon atoms. $R^7$ preferably contains from about 4 to 8 carbon atoms. $R^5$ may be straight chain or branched alkyl, substituted aryl or alkylaryl containing branching, substitution, or both and may be sourced from either synthetic sources or natural sources including for example, tallow fat. Analogous structural variations are permissible for $R^7$. $R^7$ can include alkyl, aryl, wherein said $R^7$ may also contain halogen, nitrogen, sulphur and other typical substituent groups or organic compounds. $R^6$ is preferably H or methyl. $R^5$ and $R^6$ should not contain more than 18 carbon atoms total. Amide substituted bleach activator compounds of this type are described in EP-A-0170386.

Preferred examples of bleach precursors of this type include amide substituted peroxyacid precursor compounds selected from (6-octanamido-caproyl)oxybenzenesulfonate, (6-decanamido-caproyl) oxybenzene-sulfonate, and the highly preferred (6-nonanamidocaproyl)oxy benzene sulfonate, and mixtures thereof as described in EP-A-0170386.

Benzoxazin Organic Peroxyacid Precursors

For the first aspect of the invention, also suitable are precursor compounds of the benzoxazin-type, as disclosed for example in EP-A-332,294 and EP-A482,807, particularly those having the formula:

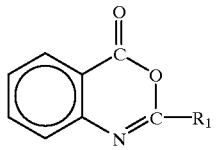

wherein $R_1$ is an alkyl, alkaryl, aryl, or arylalkyl containing at least 5 carbon atoms.

Alkyl Percarboxylic Acid Bleach Precursors

Alkyl percarboxylic acid bleach precursors form percarboxylic acids on perhydrolysis. Preferred alkyl percarboxylic precursor compounds of the imide type include the N-,N,$N^1N^1$ tetra acetylated alkylene diamines wherein the alkylene group contains at least 7 carbon atoms.

Other preferred alkyl percarboxylic acid precursors include sodium 3,5,5-tri-methyl hexanoyloxybenzene sulfonate (iso-NOBS) and sodium nonanoyloxybenzene sulfonate (NOBS).

N-acylated Lactam Precursors

Still another class of hydrophobic bleach activators are the N-acylated precursor compounds of the lactam class disclosed generally in GB-A-955735. Preferred materials of this class comprise the caprolactams.

Suitable caprolactam bleach precursors are of the formula:

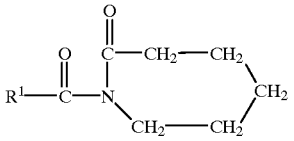

wherein $R^1$ is an alkyl, aryl, alkoxyaryl or alkaryl group containing from 6 to 12 carbon atoms. Preferred hydrophobic N-acyl caprolactam bleach precursor materials are selected from benzoyl caprolactam, octanoyl caprolactam, nonanoyl caprolactam, decanoyl caprolactam, undecenoyl caprolactam, 3,5,5-trimethylhexanoyl caprolactam and mixtures thereof. A most preferred is nonanoyl caprolactam.

Suitable valero lactams have the formula:

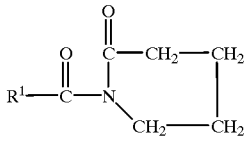

wherein $R^1$ is an alkyl, aryl, alkoxyaryl or alkaryl group containing from 6 to 12 carbon atoms. More preferably, $R^1$ is selected from phenyl, heptyl, octyl, nonyl, 2,4,4-trimethylpentyl, decenyl and mixtures thereof.

Mixtures of any of the peroxyacid bleach precursor, herein before described, may also be used.

The cationic surfactant and hydrophobic organic peroxyacid precursor are preferably present in the detergent composition at a ratio of 25:1 to 1:1, most preferably at a ratio of 10:1 to 1:1.

Preformed Organic Peroxyacid

The organic peroxyacid bleaching system may contain, in addition to, or as an alternative to, an organic peroxyacid bleach precursor compound, a preformed hydrophobic organic peroxyacid , typically at a level of from 0.05% to 20% by weight, more preferably from 1% to 10% by weight of the composition.

A preferred class of hydrophobic organic peroxyacid compounds are the amide substituted compounds of the following general formulae:

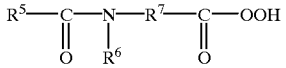

or

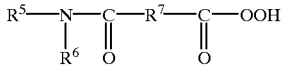

wherein $R^5$ is an aryl or alkaryl group with from about 1 to about 14 carbon atoms, $R^7$ is an alkylene, arylene, and alkarylene group containing from about 1 to 14 carbon atoms, and $R^6$ is H or an alkyl, aryl, or alkaryl group containing 1 to 10 carbon atoms. $R^5$ preferably contains from about 6 to 12 carbon atoms. $R^7$ preferably contains from about 4 to 8 carbon atoms. $R^5$ may be straight chain or branched alkyl, substituted aryl or alkylaryl containing branching, substitution, or both and may be sourced from either synthetic sources or natural sources including for example, tallow fat. Analogous structural variations are permissible for $R^7$. $R^7$ can include alkyl, aryl, wherein said $R^7$ may also contain halogen, nitrogen, sulphur and other typical substituent groups or organic compounds. $R^6$ is preferably H or methyl. $R^5$ and $R^6$ should not contain more than 18 carbon atoms total. Amide substituted bleach activator compounds of this type are described in EP-A-0170386. Suitable examples of this class of agents include (6-octylamino)-6-oxo-caproic acid, (6-nonylamino)-6-oxo-caproic acid, (6-decylamino)-6-oxo-caproic acid, magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, U.S. Pat. No. 4,634,551, EP 0,133,354, U.S. Pat. No. 4,412,934 and EP 0,170,386. A preferred hydrophobic preformed peroxyacid bleach compound for the purpose of the invention is nonanonylamido peroxycarboxylic acid.

Other suitable organic peroxyacids for the first aspect of the invention include diperoxyalkanedioc acids having more than 7 carbon atoms, such as diperoxydodecanedioc acid, diperoxytetradecanedioc acid and diperoxyhexadecanedioc acid.

Other suitable organic peroxyacids include diamino peroxyacids, which are disclosed in WO 95/03275, with the following general formula:

$$MOCR(=O)—(R^1N)_n—C(=O)(NR^2)_{n'}—R^3—(R^2N)_{m'}—C(=O)(NR^1)_m—R(=O)COOM$$

wherein:

R is selected from the group consisting of $C_1$–$C_{12}$ alkylene, $C_5$–$C_{12}$ cycloalkylene, $C_6$–$C_{12}$ arylene and radical combinations thereof;

$R^1$ and $R^2$ are independently selected from the group consisting of H, $C_1$–$C_{16}$ alkyl and $C_6$–$C_{12}$ aryl radicals and a radical that can form a $C_3$–$C_{12}$ ring together with $R^3$ and both nitrogens; $R^3$ is selected from the group consisting of $C_1$–$C_{12}$ alkylene, $C_5$–$C_{12}$ cycloalkylene and $C_6$–$C_{12}$ arylene radicals; n and n' each are an integer chosen such that the sum thereof is 1; m and m' each are an integer chosen such that the sum thereof is 1; and M is selected from the group consisting of H, alkali metal, alkaline earth metal, ammonium, alkanolammonium cations and radicals and combinations thereof.

Other suitable organic peroxyacids are include the amido peroxyacids which are disclosed in WO 95/16673, with the following general structure:

X—Ar—CO—NY—R(Z)—CO—OOH in which X represents hydrogen or a compatible substituent, Ar is an aryl group, R represents $(CH_2)_n$ in which n=2 or 3, and Y and Z each represent independently a substituent selected from hydrogen or an alkyl or aryl or alkaryl group or an aryl group substituted by a compatible substituent provided that at least one of Y and Z is not hydrogen if n=3. The substituent X on the benzene nucleus is preferably a hydrogen or a meta or para substituent, selected from the group comprising halogen, typically chlorine atom, or some other non-released non-interfering species such as an alkyl group, conveniently up to C6 for example a methyl, ethyl or propyl group. Alternatively, X can represent a second amido-percarboxylic acid substituent of formula:

—CO—NY—R(Z)—CO—OOH in which R, Y, Z and n are as defined above.

$$MOOC—R^1CO—NR^2—R^3—NR^4—CO—R^5COOOM$$

wherein $R^1$ is selected from the group consisting of $C_1$–$C_{12}$ alkylene, $C_5$–$C_{12}$ cycloalkylene, $C_6$–$C_{12}$ arylene and radical combinations thereof; R.

Preferred detergent compositions according to the present invention additionally comprise a hard base organic polymeric component. Preferably the total cationic surfactant and hard base polymeric component will be present in the detergent composition at a weight ratio 10:1 to 1:3, most preferably 5:1 to 1:2.

The hard base polymeric component preferably comprises a polymer having a pendant group (that is to say a group which is not a polymeric linkage group, so that it does not form part of the polymer backbone) which is a harder base than a benzene sulphonate group

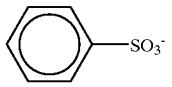

in accordance with Pearson's classification of hard and soft behavior. Preferably the polymeric component comprises a polymer having a pendant group which is a harder base than a sulphonate group such as $CH_3CH_2CH_2$—$SO_3$—. The polymeric component is generally formed from at least 5%, preferably at least 25% by weight of monomers which result in such pendant groups. The polymeric component preferably has a molecular weight of from 1500 to 150000 most preferably from 2000 to 100000, especially 5000 to 80000. Molecular weight measurements are obtained by GPC using styrene as a standard.

Particularly preferred pendant groups are carboxylic groups (references herein to acid groups also include their salts). Acrylic and maleic homopolymers or copolymers are particularly preferred.

The hard base polymer may be any organic polymeric material having a hard base group commonly used as dispersants, and anti-redeposition and soil suspension agents in detergent compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1500–5000 and their copolymers with maleic anhydride, such copolymers having a molecular weight of from 2,000 to 100,000, especially 5,000 to 80,000, or even 10,000 to 50,000.

The polyamino compounds are usefull herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

The hard base polymeric component is preferably present as components of any particulate components where they may be beneficial as a binder.

Additional Detergent Components

The detergent compositions of the invention may also contain additional detergent components. The precise nature of these additional components, and levels of incorporation thereof will depend on the physical form of the composition, and the precise nature of the washing operation for which it is to be used.

The compositions of the invention preferably contain one or more additional detergent components selected from additional surfactants, additional bleaches, bleach catalysts, alkalinity systems, builders, organic polymeric compounds, additional enzymes, suds suppressors, lime soap dispersants, soil suspension and anti-redeposition agents and corrosion inhibitors.

Additional Surfactant

The detergent compositions of the invention may contain an additional surfactant selected from anionic, nonionic, additional cationic, ampholytic, amphoteric and zwitterionic surfactants and mixtures thereof.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitteronic surfactants are generally used in combination with one or more anionic and/or nonionic surfactants.

Anionic Surfactant

The detergent compositions of the present invention preferably comprise an additional anionic surfactant. Essentially any anionic surfactants useful for detersive purposes can be comprised in the detergent composition. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N-($C_1$–$C_4$ alkyl) and -N-($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_xCH_2COO^-M^+$ wherein R is a $C_6$ to $C_{18}$ alkyl group, x ranges from O to 10, and the ethoxylate distribution is such that, on a weight basis, the amount of material where x is 0 is less than 20% and M is a cation. Suitable alkyl polyethoxy polycarboxylate surfactants include those having the formula $RO—(CHR_1—CHR_2O)R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Alkali Metal Sarcosinate Surfactant

Other suitable anionic surfactants are the alkali metal sarcosinates of formula R-CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula $$R^2O(C_nH_{2n}O)t(glycosyl)_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^{31}$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Cationic Surfactants

Additional cationic surfactants may also be used in the detergent compositions herein. Suitable cationic surfactants include the ethoxylated quaternary ammonium surfactants as described in GB-A-2040990, or ester surfactants. Suitable cationic ester surfactants, including choline ester surfactants, have for example been disclosed in U.S. Pat. Nos. 4,228,042, 4,239,660 and 4,260,529.

Alkalinity

In the detergent compositions of the present invention preferably a alkalinity system is present to achieve optimal cationic ester surfactant performance. The alkalinity system comprises components capable of providing alkalinity species in solution. By alkalinity species it is meant herein: carbonate, bicarbonate, hydroxide, the various silicate anions, percarbonate, perborates, perphosphates, persulfate and persilicate. Such alkalinity species can be formed for example, when alkaline salts selected from alkali metal or alkaline earth carbonate, bicarbonate, hydroxide or silicate, including crystalline layered silicate, salts and percarbonate, perborates, perphosphates, persulfate and persilicate salts and any mixtures thereof are dissolved in water.

Examples of carbonates are the alkaline earth and alkali metal carbonates, including sodium carbonate and sesquicarbonate and any mixtures thereof with ultra-fine calcium carbonate such as are disclosed in German Patent Application No. 2,321,001 published on Nov. 15, 1973.

Suitable silicates include the water soluble sodium silicates with an $SiO_2$:$Na_2O$ ratio of from 1.0 to 2.8, with ratios of from 1.6 to 2.0 being preferred, and 2.0 ratio being most preferred. The silicates may be in the form of either the anhydrous salt or a hydrated salt. Sodium silicate with an $SiO_2$:$Na_2O$ ratio of 2.0 is the most preferred silicate.

Preferred crystalline layered silicates for use herein have the general formula $$NaMSi_x0_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. Herein, x in the general formula above preferably has a value of 2, 3 or 4 and is preferably 2. The most preferred material is δ-$Na_2Si_2O_5$, available from Hoechst AG as NaSKS-6.

Water-soluble Builder Compound

The detergent compositions of the present invention preferably contain a water-soluble builder compound, typically present at a level of from 1% to 80% by weight, preferably from 10% to 70% by weight, most preferably from 20% to 60% by weight of the composition.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, phosphates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The detergent compositions of the present invention may contain a partially soluble or insoluble builder compound, typically present at a level of from 1% to 80% by weight, preferably from 10% to 70% by weight, most preferably from 20% to 60% weight of the composition.

Examples of largely water insoluble builders include the sodium aluminosilicates.

Suitable aluminosilicate zeolites have the unit cell formula $Na_z[(AlO_2)_z(SiO_2)y]. xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula $$Na_{12}[AlO_2)_{12}(SiO_2)_{12}]. xH_2O$$

wherein x is from 20 to 30, especially 27. Zeolite X has the formula $Na_{86}[(AlO_2)_{86}(SiO_2)_{106}]. 276\ H_2O$.

Bleach Catalyst

The compositions optionally contain a transition metal containing bleach catalyst. One suitable type of bleach catalyst is a catalyst system comprising a heavy metal cation of defined bleach catalytic activity, such as copper, iron or manganese cations, an auxiliary metal cation having little or no bleach catalytic activity, such as zinc or aluminum cations, and a sequestrant having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of these catalysts include $Mn^{IV}{}_2(u\text{-}O)_3$(1,4,7-trimethyl-1,4,7-triazacyclononane)$_2$-$(PF_6)_2$, $Mn^{III}{}_2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)4-$(ClO_4)_2$, $Mn^{III}Mn^{IV}{}_4(u\text{-}O)_1(u\text{-}OAc)_2$-(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3(PF_6)$. Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C-OH groups. Other examples include binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]\text{-}(ClO_4)_3$.

Further suitable bleach catalysts are described, for example, in European patent application No. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Patent specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Heavy Metal Ion Sequestrant

The detergent compositions of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the compositions.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof. Especially preferred is ethylenediamine-N,N'-disuccinic acid (EDDS) or the alkali metal, alkaline earth metal, ammonium, or substituted ammonium salts thereof, or mixtures thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The δ-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are also suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Enzyme

Another preferred ingredient useful in the detergent compositions is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. No. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl and BAN by Novo Industries A/S. Amylase enzyme may be incorporated into the composition in accordance with the invention at a level of from 0.0001% to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of *Humicola* sp., *Thermomyces* sp. or *Pseudomonas* sp. including *Pseudomonas pseudoalcaligenes* or *Pseudomas fluorescens*. Lipase from chemically or genetically modified mutants of these strains are also useful herein.

A preferred lipase is derived from *Pseudomonas pseudoalcaligenes* which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Organic Polymeric Compound

Organic polymeric compounds such as the hard base polymeric components described above are preferred additional components of the detergent compositions in accord with the invention, and are preferably present as components of any particulate components where they may act such as to bind the particulate component together. By organic polymeric compound it is meant herein essentially any polymeric organic compound commonly used as dispersants, and anti-redeposition and soil suspension agents in detergent compositions, including any of the high molecular weight organic polymeric compounds described as clay flocculating agents herein.

Organic polymeric compound is typically incorporated in the detergent compositions of the invention at a level of from 0.1% to 30%, preferably from 0.5% to 15%, most preferably from 1% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcellulose.

Further useful organic polymeric compounds are the polyethylene glycols, particularly those of molecular weight 1000–10000, more particularly 2000 to 8000 and most preferably about 4000.

Suds Suppressing System

The detergent compositions of the invention, when formulated for use in machine washing compositions, preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises (a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;

wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Clay Softening System

The detergent compositions may contain a clay softening system comprising a clay mineral compound and optionally a clay flocculating agent.

The clay mineral compound is preferably a smectite clay compound. Smectite clays are disclosed in the U.S. Pat. Nos 3,862,058, 3,948,790, 3,954,632 and 4,062,647. European Patents Nos. EP-A-299,575 and EP-A-313,146 in the name of the Procter and Gamble Company describe suitable organic polymeric clay flocculating agents.

Polymeric Dye Transfer Inhibiting Agents

The detergent compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

a) Polyamine N-oxide Polymers

Polyamine N-oxide polymers suitable for use herein contain units having the following structure formula:

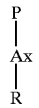

(I)

wherein P is a polymerisable unit, and

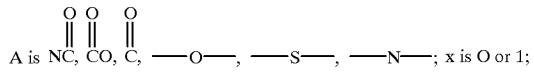

R are aliphatic, ethoxylated aliphatics, aromatic, heterocyclic or alicyclic groups or any combination thereof whereto the nitrogen of the N-O group can be attached or wherein the nitrogen of the N-O group is part of these groups.

The N-O group can be represented by the following general structures:

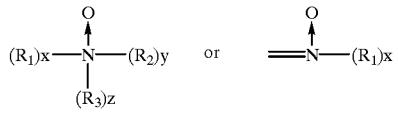

wherein R1, R2, and R3 are aliphatic groups, aromatic, heterocyclic or alicyclic groups or combinations thereof, x or/and y or/and z is 0 or 1 and wherein the nitrogen of the N-O group can be attached or wherein the nitrogen of the N-O group forms part of these groups. The N-O group can be part of the polymerisable unit (P) or can be attached to the polymeric backbone or a combination of both.

Suitable polyamine N-oxides wherein the N-O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N-O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Other suitable polyamine N-oxides are the polyamine oxides whereto the N-O group is attached to the polymerisable unit. A preferred class of these polyamine N-oxides comprises the polyamine N-oxides having the general formula (I) wherein R is an aromatic,heterocyclic or alicyclic groups wherein the nitrogen of the N-O functional group is part of said R group. Examples of these classes are polyamine oxides wherein R is a heterocyclic compound such as pyrridine, pyrrole, imidazole and derivatives thereof.

The polyamine N-oxides can be obtained in almost any degree of polymerisation. The degree of polymerisation is not critical provided the material has the desired water-solubility and dye-suspending power. Typically, the average molecular weight is within the range of 500 to 1000,000.

b) Copolymers of N-vinylpyrrolidone and N-vinylimidazole

Suitable herein are coploymers of N-vinylimidazole and N-vinylpyrrolidone having an average molecular weight range of from 5,000 to 50,000. The preferred copolymers have a molar ratio of N-vinylimidazole to N-vinylpyrrolidone from 1 to 0.2.

c) Polyvinylpyrrolidone

The detergent compositions herein may also utilize polyvinylpyrrolidone ("PVP") having an average molecular weight of from 2,500 to 400,000. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). PVP K-15 is also available from ISP Corporation. Other suitable polyvinylpyrrolidones which are commercially available from BASF Cooperation include Sokalan HP 165 and Sokalan HP 12.

d) Polyvinyloxazolidone

The detergent compositions herein may also utilize polyvinyloxazolidones as polymeric dye transfer inhibiting agents. Said polyvinyloxazolidones have an average molecular weight of from 2,500 to 400,000.

e) Polyvinylimidazole

The detergent compositions herein may also utilize polyvinylimidazole as polymeric dye transfer inhibiting agent. Said polyvinylimidazoles preferably have an average molecular weight of from 2,500 to 400,000.

Optical Brightener

The detergent compositions herein also optionally contain from about 0.005% to 5% by weight of certain types of hydrophilic optical brighteners.

Hydrophilic optical brighteners useful herein include those having the structural formula:

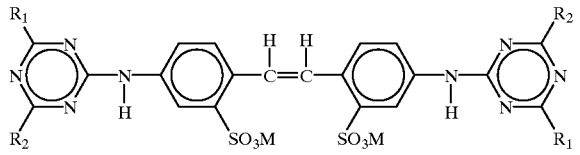

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2 -bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylatino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Cationic Fabric Softening Agents

Cationic fabric softening agents can also be incorporated into compositions in accordance with the present invention. Suitable cationic fabric softening agents include the water insoluble tertiary amines or dilong chain amide materials as disclosed in GB-A-1 514 276 and EP-B-0 011 340.

Cationic fabric softening agents are typically incorporated at total levels of from 0.5% to 15% by weight, normally from 1% to 5% by weight.

Other Optional Ingredients

Other optional ingredients suitable for inclusion in the compositions of the invention include colours and filler salts, with sodium sulfate being a preferred filler salt.

pH of the Compositions

The present compositions preferably have a pH measured as a 1% solution in distilled water of at least 8.5, preferably from 9.0 to 12.5, most preferably from 9.5 to 11.0.

Form of the Compositions

The compositions in accordance with the invention can take a variety of physical forms including granular, tablet, bar and liquid forms. The compositions are particularly the so-called concentrated granular detergent compositions adapted to be added to a washing machine by means of a dispensing device placed in the machine drum with the soiled fabric load.

In general, granular detergent compositions in accordance with the present invention can be made via a variety of methods including dry mixing, spray drying, agglomeration and granulation.

The mean particle size of the components of granular compositions in accordance with the invention should preferably be such that no more that 5% of particles are greater than 1.7 mm in diameter and not more than 5% of particles are less than 0.15 mm in diameter.

The term mean particle size as defined herein is calculated by sieving a sample of the composition into a number of fractions (typically 5 fractions) on a series of Tyler sieves. The weight fractions thereby obtained are plotted against the aperture size of the sieves. The mean particle size is taken to be the aperture size through which 50% by weight of the sample would pass.

The bulk density of granular detergent compositions in accordance with the present invention typically have a bulk density of at least 600 g/litre, more preferably from 650 g/litre to 1200 g/litre. Bulk density is measured by means of a simple funnel and cup device consisting of a conical funnel moulded rigidly on a base and provided with a flap valve at its lower extremity to allow the contents of the funnel to be emptied into an axially aligned cylindrical cup disposed below the funnel. The funnel is 130 mm high and has internal diameters of 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement eg; a knife, across its upper edge. The filled cup is then weighed and the value obtained for the weight of powder doubled to provide a bulk density in g/litre. Replicate measurements are made as required.

Surfactant Agglomerate Particles

The cationic ester surfactant herein, preferably with additional surfactants, is preferably present in granular compositions in the form of surfactant agglomerate particles, which may take the form of flakes, prills, marumes, noodles, ribbons, but preferably take the form of granules. The most preferred way to process the particles is by agglomerating powders (e.g. aluminosilicate, carbonate) with high active surfactant pastes and to control the particle size of the resultant agglomerates within specified limits. Such a process involves mixing an effective amount of powder with a high active surfactant paste in one or more agglomerators such as a pan agglomerator, a Z-blade mixer or more preferably an in-line mixer such as those manufactured by Schugi (Holland) BV, 29 Chroomstraat 8211 AS, Lelystad, Netherlands, and Gebruder Lodige Maschinenbau GmbH, D-4790 Paderborn 1, Elsenerstrasse 7–9, Postfach 2050, Germany. Most preferably a high shear mixer is used, such as a Lodige CB (Trade Name).

A high active surfactant paste comprising from 50% by weight to 95% by weight, preferably 70% by weight to 85% by weight of surfactant is typically used. The paste may be pumped into the agglomerator at a temperature high enough to maintain a pumpable viscosity, but low enough to avoid degradation of the anionic surfactants used. An operating temperature of the paste of 50° C. to 80° C. is typical.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 40 g to 300 g of product dissolved or dispersed in a wash solution of volume from 5 to 65 litres, as are typical product dosages and wash solution volumes commonly employed in conventional machine laundry methods.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

To allow for release of the detergent product during the wash the device may possess a number of openings through which the product may pass. Alternatively, the device may be made of a material which is permeable to liquid but impermeable to the solid product, which will allow release of dissolved product. Preferably, the detergent product will be rapidly released at the start of the wash cycle thereby providing transient localised high concentrations of product in the drum of the washing machine at this stage of the wash cycle.

Preferred dispensing devices are reusable and are designed in such a way that container integrity is maintained in both the dry state and during the wash cycle. Especially preferred dispensing devices for use with the composition of the invention have been described in the following patents; GB-B-2, 157, 717, GB-B-2, 157, 718, EP-A-0201376, EP-A-0288345 and EP-A-0288346. An article by J.Bland published in Manufacturing Chemist, November 1989, pages 41–46 also describes especially preferred dispensing devices for use with granular laundry products which are of a type commonly know as the "granulette". Another preferred dispensing device for use with the compositions of this invention is disclosed in PCT Patent Application No. WO94/11562.

Especially preferred dispensing devices are disclosed in European Patent Application Publication Nos. 0343069 & 0343070. The latter Application discloses a device comprising a flexible sheath in the form of a bag extending from a support ring defining an orifice, the orifice being adapted to admit to the bag sufficient product for one washing cycle in a washing process. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form.

Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

Packaging for the Compositions

Commercially marketed executions of the bleaching compositions can be packaged in any suitable container including those constructed from paper, cardboard, plastic materials and any suitable laminates. A preferred packaging execution is described in European Application No. 94921505.7.

Abbreviations Used in Examples

In the detergent compositions, the abbreviated component identifications have the following meanings:

LAS: Sodium linear $C_{12}$ alkyl benzene sulfonate

TAS: Sodium tallow alkyl sulfate

C45AS: Sodium $C_{14}$–$C_{15}$ linear alkyl sulfate

CxyEzS: Sodium $C_{1x}$–$C_{1y}$ branched alkyl sulfate condensed with z moles of ethylene oxide C45E7: A $C_{14-15}$ predominantly linear primary alcohol condensed with an average of 7 moles of ethylene oxide C25E3: A $C_{12-15}$ branched primary alcohol condensed with an average of 3 moles of ethylene oxide C25E5: A $C_{12-15}$ branched primary alcohol condensed with an average of 5 moles of ethylene oxide CEQ I: $R_1COOCH_2CH_2.N^+(CH_3)_3$ with $R_1=C_{11}–C_{13}$ CEQ II: $R_1COOCH_2CH_2CH_2N^+(CH_3)_3$ with $R_1=C_{11}–C_{13}$ CEQ III: $R_1COOCH_2CH_2N^+(CH_3)_2(CH_2CH_2OH)$ with $R_1=C_{11}–C_{13}$ CEQ IV: $R_1COOCH_2CH_2N^+(CH_3CH_2)_2(CH_3)$ with $R_1=C_{11}–C_{13}$ QAS I: $R_2.N^+(CH_3)_2(C_2H_4OH)$ with $R_2=C_{12}–C_{14}$ QAS II: $R_2.N^+(CH_3)_2(C_2H_4OH)$ with $R_2=C_8$ QAS III: $R_2.N^+(CH_3)_2(C_2H_4OH)$ with $R_2$=50% $C_9$; 50% $C_{11}$ QAS IV: $R_2.N^+(CH_3)_2(C_2H_4OH)$ with $R_2$=70% $C_{10}$; 30% $C_8$ Soap: Sodium linear alkyl carboxylate derived from an 80/20 mixture of tallow and coconut oils.

TFAA: $C_{16}–C_{18}$ alkyl N-methyl glucamide

TPKFA: C12–C14 topped whole cut fatty acids

STPP: Anhydrous sodium tripolyphosphate

Zeolite A: Hydrated Sodium Aluminosilicate of formula $Na_{12}(A10_2SiO_2)_{12}$. $27H_2O$ having a primary particle size in the range from 0.1 to 10 micrometers NaSKS-6: Crystalline layered silicate of formula $\delta$-$Na_2Si_2O_5$ Citric acid: Anhydrous citric acid Carbonate: Anhydrous sodium carbonate with a particle size between 200$\mu$m and 900$\mu$m Bicarbonate: Anhydrous sodium bicarbonate with a particle size distribution between 400$\mu$m and 1200$\mu$m Silicate: Amorphous Sodium Silicate ($SiO_2$:$Na_2O$; 2.0 ratio)

Sodium sulfate: Anhydrous sodium sulfate

Citrate: Tri-sodium citrate dihydrate of activity 86.4% with a particle size distribution between 425$\mu$m and q 850$\mu$m MA/AA: Copolymer of 1:4 maleic/acrylic acid, average molecular weight about 70,000.

CMC: Sodium carboxymethyl cellulose

Protease: Proteolytic enzyme of activity 4KNPU/g sold by NOVO Industries A/S under the tradename Savinase Alcalase: Proteolytic enzyme of activity 3AU/g sold by NOVO Industries A/S Cellulase: Cellulytic enzyme of activity 1000 CEVU/g sold by NOVO Industries A/S under the tradename Carezyme Amylase: Amylolytic enzyme of activity 60KNU/g sold by NOVO Industries A/S under the tradename Termamyl 60T Lipase: Lipolytic enzyme of activity 100kLU/g sold by NOVO Industries A/S under the tradename Lipolase Endolase: Endoglunase enzyme of activity 3000 CEVU/g sold by NOVO Industries A/S PB4: Sodium perborate tetrahydrate of nominal formula $NaBO_2.3H_2O.H_2O_2$ PB1: Anhydrous sodium perborate bleach of nominal formula $NaBO_2.H_2O_2$ Percarbonate: Sodium Percarbonate of nominal formula $2Na_2CO_3.3H_2O_2$ NOBS: Nonanoyloxybenzene sulfonate in the form of the sodium salt NAC-OBS: (Nonanamido caproyl) oxybenzene sulfonate in the form of the sodium salt.

NACA: 6 nonylamino-6 oxo-capronic acid.

TAED: Tetraacetylethylenediamine

DTPMP: Diethylene triamine penta (methylene phosphonate), marketed by Monsanto under the Trade name Dequest 2060

Photoactivated: Sulfonated Zinc Phthlocyanine encapsulated in bleach dextrin soluble polymer Brightener 1: Disodium 4,4'-bis(2-sulphostyryl)biphenyl Brightener 2: Disodium 4,4'-bis(4-anilino-6-morpholino-1.3.5-triazin-2-yl)amino) stilbene-2:2'-disulfonate.

HEDP: 1,1-hydroxyethane diphosphonic acid

PVNO: Polyvinylpyridine N-oxide

PVPVI: Copolymer of polyvinylpyrolidone and vinylimidazole

SRP 1: Sulfobenzoyl end capped esters with oxyethylene oxy and terephtaloyl backbone SRP 2: Diethoxylated poly (1,2 propylene terephtalate) short block polymer Silicone antifoam: Polydimethylsiloxane foam controller with siloxane-oxyalkylene copolymer as dispersing agent with a ratio of said foam controller to said dispersing agent of 10:1 to 100:1.

In the following Examples all levels are quoted as % by weight of the composition:

EXAMPLE 1

The following laundry detergent compositions A to F are compositions according to the invention:

| | A | B | C | D | E | F |
|---|---|---|---|---|---|---|
| LAS | 8.0 | 8.0 | 8.0 | 8.0 | 8.0 | 8.0 |
| C25E3 | 3.4 | 3.4 | 3.4 | 3.4 | 3.4 | 3.4 |
| CEQ I | 0.8 | 0.8 | 2.0 | 2.0 | 1.0 | 0.7 |
| CEQ II | — | — | 0.5 | — | — | 0.8 |
| QAS I | 0.2 | 0.5 | 0.8 | — | — | 0.8 |
| QAS II | — | — | — | 0.7 | 2.0 | — |
| Zeolite A | 18.1 | 18.1 | 18.1 | 18.1 | 18.1 | 18.1 |
| Carbonate | 13.0 | 13.0 | 13.0 | 27.0 | 27.0 | 27.0 |
| Silicate | 1.4 | 1.4 | 1.4 | 3.0 | 3.0 | 3.0 |
| Sodium sulfate | 26.1 | 26.1 | 26.1 | 26.1 | 26.1 | 26.1 |
| PB4 | 9.0 | 9.0 | 9.0 | 9.0 | 9.0 | 9.0 |
| NAC OBS | 2.5 | 1.5 | 3.0 | 4.0 | 3.2 | 2.2 |
| DETPMP | 0.25 | 0.25 | 0.25 | 0.25 | 0.25 | 0.25 |
| HEDP | 0.3 | 0.3 | 0.3 | 0.3 | 0.3 | 0.3 |
| Protease | 0.26 | 0.26 | 0.26 | 0.26 | 0.26 | 0.26 |
| Amylase | 0.1 | 0.1 | 0.1 | 0.1 | 0.1 | 0.1 |
| MA/AA | 0.3 | 0.3 | 0.3 | 0.3 | 0.3 | 0.3 |
| CMC | 0.2 | 0.2 | 0.2 | 0.2 | 0.2 | 0.2 |
| Photoactivated bleach (ppm) | 15 ppm | 15 ppm | 15 ppm | 15 ppm | 15 ppm | 15 ppm |
| Brightener 1 | 0.09 | 0.09 | 0.09 | 0.09 | 0.09 | 0.09 |
| Perfume | 0.3 | 0.3 | 0.3 | 0.3 | 0.3 | 0.3 |
| Silicone antifoam | 0.5 | 0.5 | 0.5 | 0.5 | 0.5 | 0.5 |
| Misc/minors to 100% | | | | | | |
| Density in g/liter | 850 | 850 | 850 | 850 | 850 | 850 |

EXAMPLE 2

The following granular laundry detergent compositions G to I of bulk density 750 g/litre are compositions according to the invention:

| | G | H | I |
|---|---|---|---|
| LAS | 5.25 | 5.61 | 4.76 |
| TAS | 1.25 | 1.86 | 1.57 |
| C45A5 | — | 2.24 | 3.89 |
| C25AE3S | — | 0.76 | 1.18 |
| C45E7 | 3.25 | — | 5.0 |
| C25E3 | — | 5.5 | — |
| QAS I | 0.8 | 2.0 | 2.0 |
| QAS II | 0.4 | 1.0 | 0.5 |
| STPP | 19.7 | — | — |
| Zeolite A | — | 19.5 | 19.5 |
| NaSKS-6/citric acid (79:21) | — | 10.6 | 10.6 |
| Carbonate | 6.1 | 21.4 | 21.4 |
| Bicarbonate | — | 2.0 | 2.0 |
| Silicate | 6.8 | — | — |
| Sodium sulfate | 39.8 | — | 14.3 |
| PB4 | 5.0 | 12.7 | — |
| TAED | 0.5 | 0.2 | — |
| NAC OBS | 1.0 | 2.2 | 1.3 |
| DETPMP | 0.25 | 0.2 | 0.2 |
| HEDP | — | 0.3 | 0.3 |
| Protease | 0.26 | 0.85 | 0.85 |
| Lipase | 0.15 | 0.15 | 0.15 |
| Cellulase | 0.28 | 0.28 | 0.28 |
| Amylase | 0.1 | 0.1 | 0.1 |
| MA/AA | 0.8 | 1.6 | 1.6 |
| CMC | 0.2 | 0.4 | 0.4 |
| Photoactivated bleach (ppm) | 15 ppm | 27 ppm | 27 ppm |
| Brightener 1 | 0.08 | 0.19 | 0.19 |
| Brightener 2 | — | 0.04 | 0.04 |
| Perfume | 0.3 | 0.3 | 0.3 |
| Silicone antifoam | 0.5 | 2.4 | 2.4 |
| Minors/misc to 100% | | | |

EXAMPLE 3

The following are detergent formulations, according to the present invention where J is a phosphorus-containing detergent composition, K is a zeolite-containing detergent composition and L is a compact detergent composition:

| | J | K | L |
|---|---|---|---|
| Blown Powder | | | |
| STPP | 24.0 | — | 24.0 |
| Zeolite A | — | 24.0 | — |
| C45AS | 9.0 | 6.0 | 13.0 |
| QAS II | — | 2.0 | — |
| QAS III | — | — | 2.0 |
| QAS IV | 2.0 | — | — |
| MA/AA | 2.0 | 4.0 | 2.0 |
| LAS | 6.0 | 8.0 | 11.0 |
| TAS | 2.0 | — | — |
| Silicate | 7.0 | 3.0 | 3.0 |
| CMC | 1.0 | 1.0 | 0.5 |
| Brightener 2 | 0.2 | 0.2 | 0.2 |
| Soap | 1.0 | 1.0 | 1.0 |
| DTPMP | 0.4 | 0.4 | 0.2 |
| Spray On | | | |
| C45E7 | 2.5 | 2.5 | 2.0 |
| C25E3 | 2.5 | 2.5 | 2.0 |
| Silicone antifoam | 0.3 | 0.3 | 0.3 |
| Perfume | 0.3 | 0.3 | 0.3 |
| Dry additives | | | |
| Carbonate | 6.0 | 13.0 | 15.0 |
| PB4 | 18.0 | 18.0 | 10.0 |
| PB1 | 4.0 | 4.0 | 0 |
| NOBS | 3.0 | 4.2 | 1.0 |
| Photoactivated bleach | 0.02 | 0.02 | 0.02 |

-continued

| | J | K | L |
|---|---|---|---|
| Protease | 1.0 | 1.0 | 1.0 |
| Lipase | 0.4 | 0.4 | 0.4 |
| Amylase | 0.25 | 0.30 | 0.15 |
| Dry mixed sodium sulfate | 3.0 | 3.0 | 5.0 |
| Balance (Moisture & Miscellaneous) | to 100.0 | to 100.0 | to 100.0 |
| Density (g/litre) | 630 | 670 | 670 |

EXAMPLE 4

The following are detergent formulations according to the present invention:

| | P | Q | R | S |
|---|---|---|---|---|
| LAS | 20.0 | 14.0 | 24.0 | 22.0 |
| QAS I | 0.7 | 1.0 | — | 0.7 |
| CEQ III | 0.4 | 0.4 | 2.2 | 1.5 |
| CEQ IV | 1.5 | 0.4 | 1.0 | 1.5 |
| TFAA | — | 1.0 | — | — |
| C25E5/C45E7 | — | 2.0 | — | 0.5 |
| C45E3S | — | 2.5 | — | — |
| STPP | 30.0 | 18.0 | 30.0 | 22.0 |
| Silicate | 9.0 | 5.0 | 10.0 | 8.0 |
| Carbonate | 13.0 | 7.5 | — | 5.0 |
| Bicarbonate | — | 7.5 | — | — |
| DTPMP | 0.7 | 1.0 | — | — |
| SRP 1 | 0.3 | 0.2 | — | 0.1 |
| MA/AA | 2.0 | 1.5 | 2.0 | 1.0 |
| CMC | 0.8 | 0.4 | 0.4 | 0.2 |
| Protease | 0.8 | 1.0 | 0.5 | 0.5 |
| Amylase | 0.8 | 0.4 | — | 0.25 |
| Lipase | 0.2 | 0.1 | 0.2 | 0.1 |
| Cellulase | 0.15 | 0.05 | — | — |
| Photoactivated bleach (ppm) | 70 ppm | 45 ppm | — | 10 ppm |
| Brightener 1 | 0.2 | 0.2 | 0.08 | 0.2 |
| PB1 | 6.0 | 2.0 | — | — |
| NAC OBS | 2.0 | 1.0 | 0.9 | 3.1 |
| Balance (Moisture and Miscellaneous) | 100 | 100 | 100 | 100 |

EXAMPLE 5

The following are detergent formulations according to the present invention:

| | T | U | V |
|---|---|---|---|
| Blown Powder | | | |
| QAS IV | — | 0.4 | 1.5 |
| QAS II | 1.5 | 1.5 | 1.5 |
| Zeolite A | 30.0 | 22.0 | 6.0 |
| Sodium sulfate | 19.0 | 5.0 | 7.0 |
| MA/AA | 3.0 | 3.0 | 6.0 |
| LAS | 14.0 | 12.0 | 22.0 |
| C45AS | 8.0 | 7.0 | 7.0 |
| Silicate | — | 1.0 | 5.0 |
| Soap | — | — | 2.0 |
| Brightener 1 | 0.2 | 0.2 | 0.2 |
| Carbonate | 8.0 | 16.0 | 20.0 |
| Spray On | | | |
| C45E7 | 1.0 | 1.0 | 1.0 |

-continued

| | T | U | V |
|---|---|---|---|
| Dry additives | | | |
| PVPVI/PVNO | 0.5 | 0.5 | 0.5 |
| Protease | 1.0 | 1.0 | 1.0 |
| Lipase | 0.4 | 0.4 | 0.4 |
| Amylase | 0.1 | 0.1 | 0.1 |
| Cellulase | 0.1 | 0.1 | 0.1 |
| NACA | 3.4 | 6.1 | 4.5 |
| Sodium sulfate | — | 6.0 | — |
| Balance (Moisture and Miscellaneous) | 100 | 100 | 100 |

EXAMPLE 6

The following are high density and bleach-containing detergent formulations according to the present invention:

| | W | X | Y |
|---|---|---|---|
| Blown Powder | | | |
| Zeolite A | 15.0 | 15.0 | 15.0 |
| Sodim sulfate | 0.0 | 5.0 | 0.0 |
| LAS | 3.0 | 3.0 | 3.0 |
| QAS I | — | 1.5 | 1.5 |
| QAS II | 0.9 | — | — |
| CEQ II | 0.5 | 0.5 | 2.7 |
| CEQ III | — | 1.2 | — |
| DTPMP | 0.4 | 0.4 | 0.4 |
| CMC | 0.4 | 0.4 | 0.4 |
| MA/AA | 4.0 | 2.0 | 2.0 |
| Agglomerates | | | |
| LAS | 5.0 | 5.0 | 5.0 |
| TAS | 2.0 | 2.0 | 1.0 |
| Silicate | 3.0 | 3.0 | 4.0 |
| Zeolite A | 8.0 | 8.0 | 8.0 |
| Carbonate | 8.0 | 8.0 | 4.0 |
| Spray On | | | |
| Perfume | 0.3 | 0.3 | 0.3 |
| C45E7 | 2.0 | 2.0 | 2.0 |
| C25E3 | 2.0 | — | — |
| Dry additives | | | |
| Citrate | 5.0 | — | 2.0 |
| Bicarbonate | — | 3.0 | — |
| Carbonate | 8.0 | 15.0 | 10.0 |
| NAC OBS | 6.0 | 2.0 | 5.0 |
| NACA | 2.0 | 1.8 | 1.2 |
| PB1 | 14.0 | 7.0 | 10.0 |
| Polyethylene oxide of MW 5,000,000 | — | — | 0.2 |
| Bentonite clay | — | — | 10.0 |
| Protease | 1.0 | 1.0 | 10 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| Dry additives | | | |
| Sodium sulfate | 0.0 | 3.0 | 0.0 |
| Balance (Moisture and Miscellaneous) | 100.0 | 100.0 | 100.0 |
| Density (g/litre) | 850 | 850 | 850 |

EXAMPLE 7

The following are high density detergent formulations according to the present invention:

| | Z | AA |
|---|---|---|
| Agglomerate | | |
| C45AS | 11.0 | 14.0 |
| QAS II | 1.8 | 2.2 |
| Zeolite A | 15.0 | 6.0 |
| Carbonate | 4.0 | 8.0 |
| MA/AA | 4.0 | 2.0 |
| CMC | 0.5 | 0.5 |
| DTPMP | 0.4 | 0.4 |
| Spray On | | |
| C25E5 | 5.0 | 5.0 |
| Perfume | 0.5 | 0.5 |
| Dry Adds | | |
| HEDP | 0.5 | 0.3 |
| SKS 6 | 13.0 | 10.0 |
| Citrate | 3.0 | 1.0 |
| NAC OBS | 4.1 | 6.2 |
| TAED | 0.8 | 1.0 |
| Percarbonate | 20.0 | 20.0 |
| SRP 1 | 0.3 | 0.3 |
| Protease | 1.4 | 1.4 |
| Lipase | 0.4 | 0.4 |
| Cellulase | 0.6 | 0.6 |
| Amylase | 0.6 | 0.6 |
| Silicone antifoam | 5.0 | 5.0 |
| Brightener 1 | 0.2 | 0.2 |
| Brightener 2 | 0.2 | — |
| Balance (Moisture and Miscellaneous) | 100 | 100 |
| Density (g/liter) | 850 | 850 |

EXAMPLE 8

The following are liquid detergent formulations according to the present invention:

| | AB | AC | AD | AE | AF | AG | AH | AI |
|---|---|---|---|---|---|---|---|---|
| CEQ I | O.4 | 1.0 | — | — | 2.0 | 2.5 | — | — |
| CEQ II | — | — | 0.7 | — | 1.2 | — | — | — |
| LAS | 10.0 | 13.0 | 9.0 | — | 25.0 | — | — | — |
| C25AS | 4.0 | 1.0 | 2.0 | 10.0 | — | 13.0 | 18.0 | 15.0 |
| C25E3S | 1.0 | — | — | 3.0 | — | 2.0 | 2.0 | 4.0 |
| C25E7 | 6.0 | 8.0 | 13.0 | 2.5 | — | — | 4.0 | 4.0 |
| TFAA | — | — | — | 4.5 | — | 6.0 | 8.0 | 8.0 |
| QAS I | — | — | — | — | 3.0 | 1.0 | — | — |
| QAS III | 0.6 | 1.2 | — | — | 3.5 | — | | |
| QAS IV | — | — | 0.8 | 0.8 | — | 3.5 | | |
| TPKFA | 2.0 | — | 13.0 | 2.0 | — | 15.0 | 7.0 | 7.0 |
| Rapeseed fatty acids | — | — | — | 5.0 | — | — | 4.0 | 4.0 |
| Citric acid | 2.0 | 3.0 | 1.0 | 1.5 | 1.0. | 1.0 | 1.0 | 1.0 |
| Dodecenyl/ tetradecenyl succinic acid | 12.0 | 10.0 | — | — | 15.0 | — | — | — |
| Oleic acid | 4.0 | 2.0 | 1.0 | — | 1.0 | — | — | — |
| Ethanol | 4.0 | 4.0 | 7.0 | 2.0 | 7.0 | 2.0 | 3.0 | 2.0 |
| 1,2 Propanediol | 4.0 | 4.0 | 2.0 | 7.0 | 6.0 | 8.0 | 10.0 | 13.— |
| Mono Ethanol Amine | — | — | — | 5.0 | — | — | 9.0 | 9.0 |
| Tri Ethanol Amine | — | — | 8 | — | — | — | — | — |
| NaOH up to pH | 8.0 | 8.0 | 7.6 | 7.7 | 8.0 | 7.5 | 8.0 | 8.2 |
| Ethoxylated tetraethylene pentamine | 0.5 | — | 0.5 | 0.2 | — | — | 0.4 | 0.3 |
| NAC OBS | 1.0 | 1.0 | 0.5 | 1.0 | 2.0 | 1.2 | 1.0 | 1.6 |
| NACA | 0.7 | 1.1 | 1.8 | 1.5 | 1.9 | 2.1 | 1.4 | 1.0 |
| $PB_4$ | 2.0 | 2.6 | 3.1 | 3.0 | 3.1 | 3.5 | 2.9 | 2.5 |

-continued

| | AB | AC | AD | AE | AF | AG | AH | AI |
|---|---|---|---|---|---|---|---|---|
| SRP 2 | 0.3 | — | 0.3 | 0.1 | — | — | 0.2 | 0.1 |
| PVNO | — | — | — | — | — | — | — | 0.10 |
| Protease | 0.5 | 0.5 | 0.4 | 0.25 | — | 0.5 | 0.3 | 0.6 |
| Alcalase | — | — | — | — | 1.5 | — | — | — |
| Lipase | — | 0.10 | — | 0.01 | — | — | 0.15 | 0.15 |
| Amylase | 0.25 | 0.25 | 0.6 | 0.5 | 0.25 | 0.9 | 0.6 | 0.6 |
| Cellulase | — | — | — | 0.05 | — | — | 0.15 | 0.15 |
| Endolase | — | — | — | 0.10 | — | — | 0.07 | — |
| Boric acid | 0.1 | 0.2 | — | 2.0 | 1.0 | 1.5 | 2.5 | 2.5 |
| Na formate | — | — | 1.0 | — | — | — | — | — |
| Ca chloride | — | 0.015 | — | 0.01 | — | — | — | — |
| Bentonite clay | — | — | — | — | 4.0 | 4.0 | — | — |
| Suspending clay SD3 | — | — | — | — | 0.6 | 0.3 | — | — |
| Balance (Moisture and Miscellaneous) | 100 | 100 | 100 | 100 | 100 | 100 | 100 | 100 |

What is claimed is:

1. A detergent composition comprising (a) from 0.05% to 4.5%, by weight of the detergent composition, of a cationic surfactant of the formula (I)

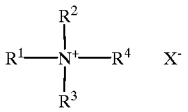

in which $R^1$ is a hydroxyalkyl group having no greater than 6 carbon atoms; each of $R^2$ and $R^3$ is independently selected from $C_{1-4}$ alkyl or alkenyl; $R^4$ is $C_{12-14}$ alkyl or alkenyl and $X^-$ is an anion selected from the group consisting of halide, methyl sulfate, sulfate, and nitrate;

(b) a hydrophobic organic peroxyacid bleaching system, capable of providing a peroxyacid compound of the formula:

(II)

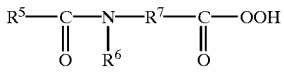

or (III)

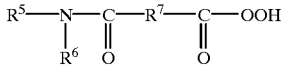

wherein $R^5$ is an alkyl, aryl or aralkyl group containing from 1 to 14 carbon atoms, $R^7$ is an alkylene, arylene or alkarylene group containing from 1 to 14 carbon atoms, and $R^6$ is H or an alkyl, aryl or alkaryl group containing from 1 to 10 carbon atoms; and (c) from 5% to about 40% by weight of sodium sulfate said composition having a pH as measured in 1% water solution from 10.0 to 11.0.

2. A detergent composition according to claim 1 in which the cationic surfactant of formula (I) is selected from those in which $R_1$ is —$CH_2CH_2OH$ or —$CH_2CH_2CH_2OH$; each of $R^2$ and $R^3$ are, independently, $C_{1-4}$ alkyl.

3. A detergent composition according to claim 1 wherein $R^1$ is —$CH_2CH_2OH$ and each of $R^2$ and $R^3$ is methyl.

4. A detergent composition according to claim 1 wherein $R^4$ is a straight chain alkyl group.

5. A detergent composition according to claim 1 additionally comprising a hard base polymeric component, the ratio of cationic surfactant to hard base polymeric component in the weight composition being from 10:1 to 1:3.

6. A method of washing laundry in a domestic washing machine in which a dispensing device containing an effective amount of a solid detergent composition according to claim 1 is introduced into a drum of the washing machine before the commencement of the wash, wherein said dispensing device permits progressive release of said detergent composition into the wash liquor during the wash.

* * * * *